US005220757A

United States Patent [19]

Hulligan

[11] Patent Number: 5,220,757

[45] Date of Patent: Jun. 22, 1993

[54] THERMAL STAIRWAY COVER

[75] Inventor: Jeffrey A. Hulligan, Bay Village, Ohio

[73] Assignee: Colorcraft, Inc., Memphis, Tenn.

[21] Appl. No.: 775,517

[22] Filed: Oct. 15, 1991

[51] Int. Cl.[5] ..... E06B 3/26

[52] U.S. Cl. ..... 52/202; 182/47; 182/77

[58] Field of Search ..... 52/202, 36, 19, 203; 182/36, 37, 47, 77, 46, 81

[56] References Cited

U.S. PATENT DOCUMENTS

| | | | |
|---|---|---|---|
| 2,945,548 | 4/1958 | Tapp | 182/77 |
| 3,849,951 | 11/1974 | Howle | 52/19 |
| 4,337,602 | 7/1982 | King | 52/202 |
| 4,344,505 | 8/1982 | Waters et al. | 182/47 |
| 4,541,208 | 9/1985 | Vesperman et al. | 52/19 |
| 4,591,022 | 5/1986 | Sciambi et al. | 52/36 X |
| 4,658,555 | 4/1987 | Steiner | 52/202 |
| 4,928,441 | 5/1990 | Daley | 52/202 |

FOREIGN PATENT DOCUMENTS

| | | | |
|---|---|---|---|
| 2106358 | 6/1979 | Fed. Rep. of Germany | 182/77 |

OTHER PUBLICATIONS

Thermal Stairway Cover, Pearson Industries, Ltd.

Folding Attic Stair-Well Cover, Forest City Fabricators.

*Primary Examiner*—Carl D. Friedman

*Assistant Examiner*—Kien Nguyen

*Attorney, Agent, or Firm*—Body, Vickers & Daniels

[57] ABSTRACT

A thermal stairway cover is disclosed for insulating a stairway opening containing a pull-down, ceiling stairway leading to an attic. A plate is movable between a first position which closes the cover and reduces heat transfer therethrough and a second position where the cover is open to provide access through the stairway opening to the attic.

34 Claims, 3 Drawing Sheets

THERMAL STAIRWAY COVER

This invention relates to a thermal insulation system and more particularly to a thermal stairway cover structure for insulating a folding stairway opening in a ceiling.

BACKGROUND OF THE INVENTION

Attic stairways are frequently overlooked as a source of heat loss in the home. Often, well-insulated attics do not provide any insulation over the stairways. This is often the case for folding stairways which are stored in an attic when not in use. Such stairs are sometimes called pull-down stairs.

Typically, such folding stairways are permanently installed in homes during construction. In the down position the stairway allows access to the attic. In the up position the stairway is stored above the ceiling level in an area of about ten square feet. The stairway is folded into a compact configuration and a thin, flat door conceals the stairway from below. The flat door is often one quarter inch thick plywood or the like and provides very little thermal insulation. The heat loss through this structure significantly effects the cost of heating and cooling the living area below the attic.

This problem has been addressed by a thermal stairway cover distributed by Pearson Industries, Ltd. of Conshohocken, Pennsylvania, incorporating a relatively heavy stairway cover including a plurality of folded sections. This design, while reducing the heat loss, was flawed because of problems associated with the danger caused by its weight and possible risk of catching an operators fingers as the sections are being folded or unfolded.

Another design was simply an overturned tub that was positioned over or around the frame around the stairway opening. The rather heavy tub was simply flipped over to gain entry to the attic. Again, this means of closing the stairway was somewhat awkward and dangerous to use because of its shape and weight. Both of the above-described techniques were unusable by older persons and others of limited physical strength.

Since energy efficient house designs are so important, a simplified, safe device to prevent heat transfer through an attic stairway is needed.

THE PRESENT INVENTION

The present invention overcomes the disadvantages of the prior art attempts to reduce heat transfer through an attic, pull-down stairway disposed in a ceiling.

In accordance with the broadest aspect of the present invention, a novel thermal cover is disposed about a stairway opening. The cover includes a flexible closure plate which can be easily moved between opened and closed positions.

The novel cover is constructed of a rectangular frame which is preferably disposed on the frame for a pull-down stairway opening extending through an attic floor to a room below. The frame has side walls and end walls which are connected together to form a box surrounding an opening which provides a substantially unobstructed access to the stairway opening. A flexible closure plate, operably engaged with the frame, has a first position to close the opening though the frame for reducing heat transfer therethrough and a second position to open the opening through the frame for providing access therethrough. Mounting structures on the side walls for sliding attachments of the closure plate to the frame enable the plate to be moved between the first and second positions.

In accordance with the details of the invention, the closure plate is a rectangular sheet of material defined by side edges extending the length of the plate and end edges extending along the width at opposite ends of the plate. The cover is preferably constructed of a sheet of plastic which is flexible along its length and relatively rigid through its width.

In the preferred embodiment, the sheet of plastic has a corrugated surface constructed of a plurality of parallel ribs and grooves disposed in a direction perpendicular to the side edges.

Further in accordance with the invention, the mounting structure on the sides of the frame include first and second grooves, one along each of the opposite inwardly facing surfaces of the side walls. Each of the grooves receives one of the side edges of the plate whereby the plate is slidingly attached to the frame for movement between the first and second positions.

Yet further in accordance with the invention, the plate has a handle attached near one end which serves as a grip to move the plate as well as a stop which contacts one of the end walls and prevents the plate from sliding completely out of the grooves.

Another novel aspect of the invention relates to a guide element attached to the outer surface of the end wall over which the plate moves as the plate is slid to its open position. The guide element has a curved upper surface upon which the plate slides. In addition, a cord extending between the guide element and the end of the plate which moves out of the frame restrains the outward movement of the plate end and forces it to bow and bend outwards so that less space is required for operating the cover and the danger of banging into one of its edges is reduced.

In operation, the pull-down stairs for access to the attic are stored within the frame of the thermal cover when the stairs are in the closed position. The stairs, besides being used to gain access to the attic, form a baffle which prevents convection currents of air in the volume between the plate and the pivoted door on which the pull-down stairs are mounted. Thus, even the pull-down stairs are used to increase the insulation value of the overall structure.

The primary object of the present invention is the provision of a thermal cover for reducing the thermal lose across pull-down stairs providing access to an attic.

Another object of the present invention is the provision of a thermal cover which is lightweight and easy to operate between the opened and closed positions and which provides or prevents access to the entranceway to an attic.

A further object of the present invention is the provision of a flexible plate which is secured to an end of the frame forming the cover so that the plate bows outward into a curved configuration as it moves out of the frame into the open position whereby less space is required for using the thermal cover.

A yet further object of the present invention is to provide a relatively small, compact, thermal cover which receives the fold down stairs providing access to an attic so that the stairs from a baffle which reduces the thermal loss between the attic and the room into which the stairs unfold.

These and other objects and advantages will become apparent from the following description taken together with the accompanying drawings described below.

BRIEF DESCRIPTION OF THE DRAWINGS

FIG. 1A is an enlarged view of the section FIG. 1A in FIG. 1;

PREFERRED EMBODIMENT OF THE INVENTION

Figure 1:
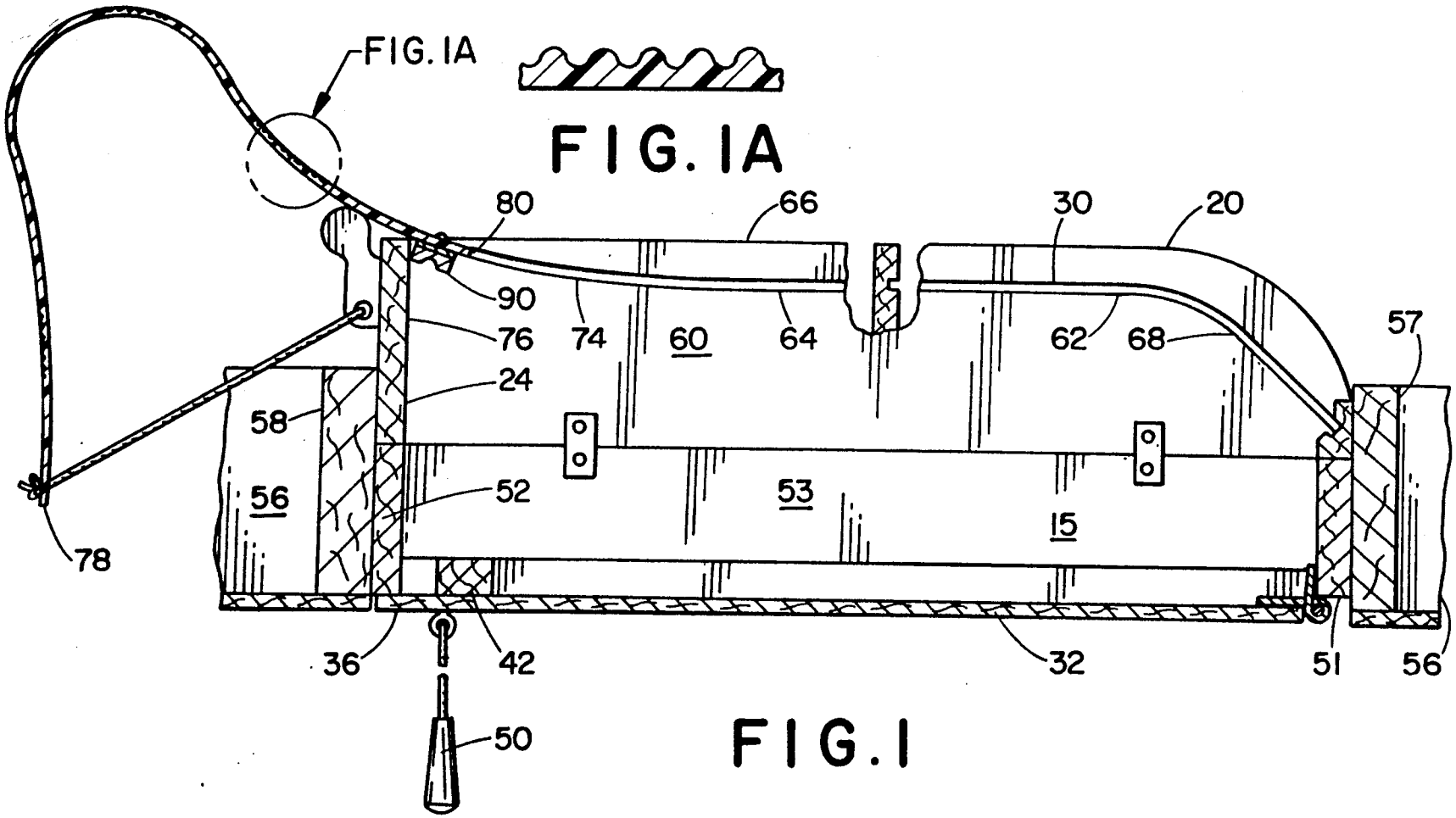
FIG. 1 is a side view in cross section of a thermal cover for an attic pull-down stairway with the steps removed and the cover in an opened position.
Figure 2:
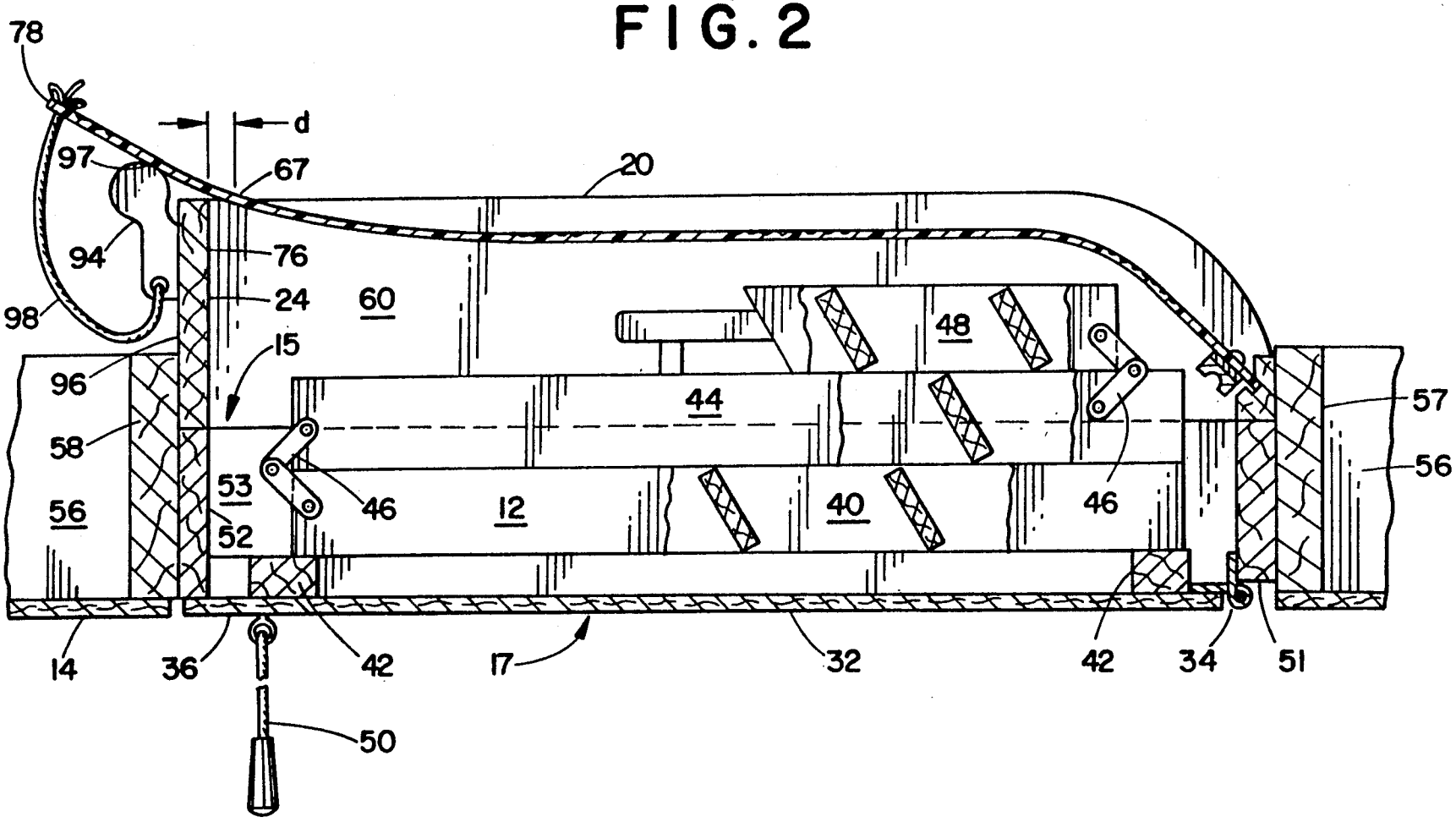
FIG. 2 is a side view in cross section of a thermal cover in a closed position; and, FIG. 3 is a perspective view of a thermal cover in the closed position with a cutout portion showing the interior and pull-down stairs pivoted into an open position.
Figure 3:
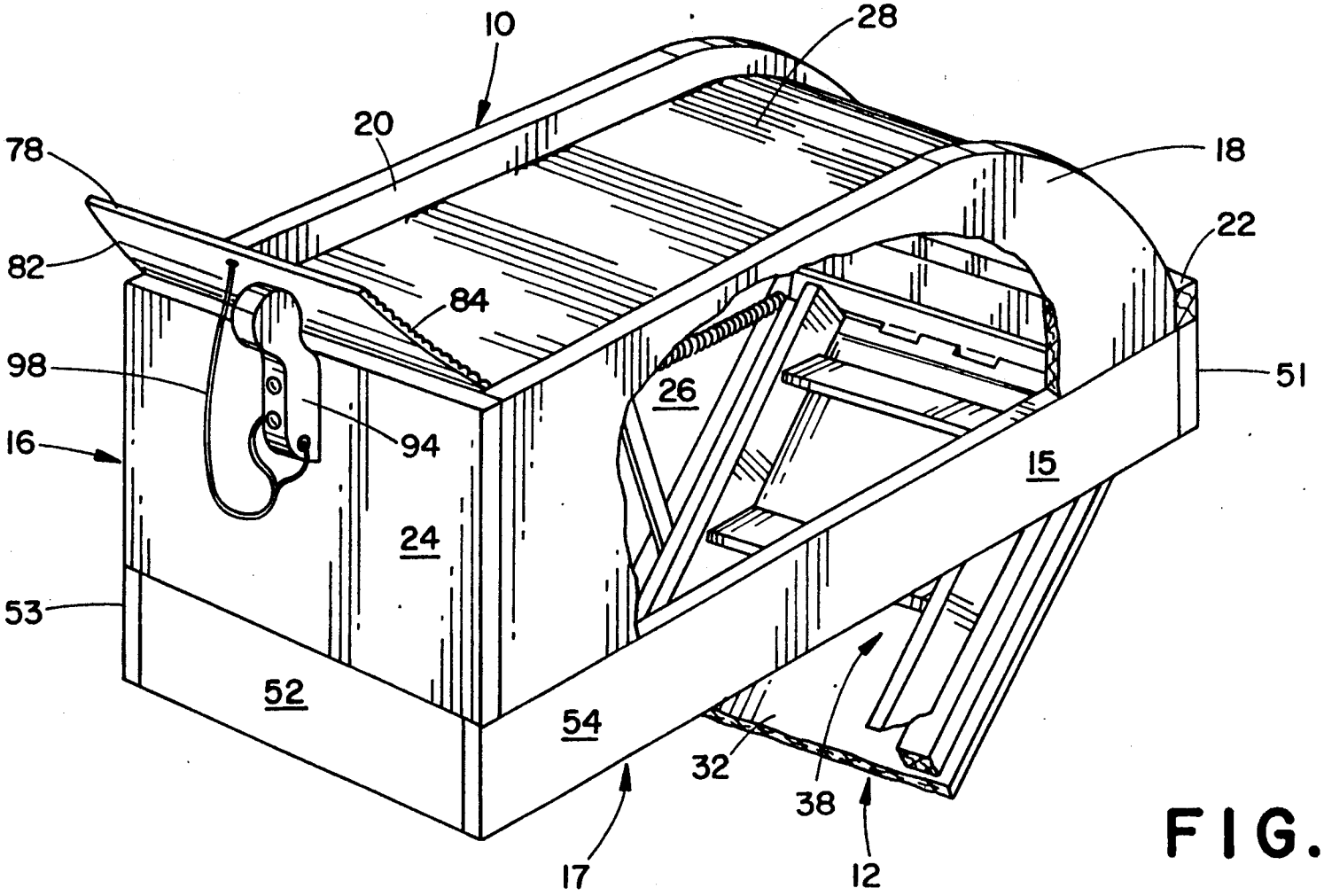

Referring now to the drawings wherein the showings are for the purpose of illustrating the preferred embodiment and not limiting same, FIGS. 1-3 illustrate a thermal cover 10 located over a pull-down stairs assembly 12 provided in a ceiling 14 for access to an attic.

Referring to FIGS. 1 and 2, there is illustrated a conventional pull-down stairs assembly 12 which is typically mounted in an opening 17 through a ceiling 14 to provide access to an attic. The stair assembly 12 includes a spring (not shown) to bias it into its closed position as seen in FIG. 2. The stair assembly generally includes a flat, rectangular door 32 which is pivotally mounted at one end 34 to the stairway frame 15 mounted in the opening 17 in ceiling 14. The other end 36 of the door 32 abuts against the lower surface of the ceiling in the closed position or against the stairway frame 15 of the pull down stair assembly 12. The frame 15 is rectangular and comprises four boards 51, 52, 53, 54 which are fastened together. The frame 15 is nailed to the house attic floor joists 56 and headers 57, 58 permanently position the pull down stair assembly 12. A fold-up step assembly 38 is secured to the door 32 as seen in FIG. 2. A first stair section 40 is spaced from the door and secured thereto by rectangular edge strips 42. A second stair section 44 is pivotally connected to the first stair section 40 by hardware hinge 46. A third stair section 48 is secured to the second stair section 44 by means of hardware hinge 46. To use the pull-down stair assembly 12, a pull cord 50 attached to the free end 36 is pulled so that the door 32 moves downward and pivots away from the ceiling 14. Then the third stair section 48 can be pulled downwards. The second stair section 44 and third stair section 48 pivot outwardly from the flat door 32 and downwardly guided by the hardware hinges 46. The stair sections 40, 44, 48 are thus longitudinally aligned and rigidly interconnected by the hardware hinges 46 usable as a stairway. Once the stairs are fully extended, their weight keeps them in the open position as partially illustrated in FIG. 3. Although one conventional type of stairs are described and illustrated, it is within the terms of the invention to use any other desired type of pull-down stairs, as conventionally known in the art.

The thermal cover 10 is constructed of a rectangular frame 16 adapted to be positioned against a support surface, such as the stairway frame 15 surrounding the stairway opening 17. The cover frame 16 includes side walls 18 and 20 and end walls 22 and 24 forming an opening 26 therethrough to provide substantially unobstructed access to the stairway opening 17. A closure plate 28 has a first position, as illustrated in FIGS. 2 and 3, to close the opening 26 for reducing heat transfer therethrough and a second position, as illustrated in FIG. 1, to open the opening 26 through the cover frame 16 for providing access therethrough. Mounting structure 30 on the side walls 18 and 20 allows for sliding attachment of the closure plate 28 to the cover frame 16 so that the plate can be moved between the first and second positions. This structure is described in detail herein below.

Referring now to FIG. 1, there is illustrated a cross sectional side view of applicant's novel thermal stairway cover 10 mounted on a pull down stair assembly 12. The inner surface 60 of the side wall 20 has a substantially rectangular groove 62 extending substantially the length of the sidewall 20. While only side wall 20 is discussed in detail, the inner surface of side wall 18 also has a groove in opposing relationship and substantially identical to the groove 62. Sidewall 18 is a mirror image of sidewall 20. The groove 62 includes a central section 64 which extends substantially parallel and adjacent to a longitudinal sidewall upper edge 66 for the majority of the length of the side wall. A closed end section 68 is curved downwards towards the lower side of the rectangular frame 16 and terminates at the end wall 22. As seen in FIG. 1, a slot 72 in the end wall 22 provides a positive stop for the closure plate 28, as will be discussed hereinafter. An opened end section 74 of the groove 62 has a concave curve facing the upper edge 66 of the side wall 20. The groove 62 extends through the upper edge 66 at exit point 67 and enables the closure plate 28 to project beyond the frame and move freely to the second position, as illustrated.

The closure plate 28 is longer than the length of the grooves 62 on the inner surface of the side walls 18 and 20 and therefore projects beyond the upper edge of the side walls in the closed position. The plate 28 has end edges 78 and 80 which extend across the width of the plate 28 at the opposite ends thereof. The end edges 78, 80 are perpendicular to the parallel, longitudinal edges 82 and 84 extending along the length of the plate 28. The width of the plate, between edges 82 and 84 is selected so that the plate is secured between the grooves 62 in sliding engagement so that the plate can be easily moved between the opened and closed positions.

The plate 28 is preferably constructed of a material which is relatively flexible along its length and relatively rigid through its width. The flexibility along the length allows the plate to flex and change shape to conform to the curvature of the rectangular grooves 62 on the opposite facing surfaces of the side walls 18 and 20 as the plate moves between the first and second positions. The substantial rigidity of the plate through its width prevents the plate from bowing and disengaging from the opposing rectangular grooves 62.

Preferably the closure plate 28 is constructed of a flexible sheet of plastic. The sheet has a corrugated surface 86 as illustrated in FIG. 1A. The corrugated surface has a plurality of parallel grooves 88 and ridges 102 disposed perpendicularly to the longitudinal extending side edges 82 and 84 of the sheet. The ridges 102 add rigidity across the width of the plate 28. In the preferred embodiment, the closure plate is constructed of plastic. However, it is within the terms of the invention to use any other desired material such as, for example, a pointed, flexible, wood panel.

A handle 90 is secured to end 80 of the plate by any desired means such as a rivet or a screw. The handle extends slightly less than the width of the leading end of plate 28 so that it does not engage the inner surface of the side walls 18 and 20 when operating the closure plate between the open and closed positions. The handle includes a groove 92 to provide a means of gripping the handle. An important function of the handle is that it stiffens the leading end of plate 28 of plastic and thereby prevents it from coming out of the grooves 62. Also, when the plate is in the second position, the handle can be wedged between the plate and the inner surface 76 of the end wall 24 so as to prevent the plate from sliding completely out of the grooves 62 or moving back to the closed position.

The distance "d" (FIG. 2) between the exit point 67 and the end wall 24 is selected such that the handle 90 abuts against the inner surface 76 of the end wall 24 and thereby prevents the closure plate from sliding completely out of the grooves 62 when it is fully opened in the second position, as shown in FIG. 1. The distance "d" and exit angle of the grooves 62 position the closure plate so that it rests lightly against or is slightly spaced above the top of the closure end wall 24. As can best be seen in FIGS, 2 and 3, a relatively air tight volume is created within the thermal cover 10. The volume is provided with baffles by the folded step structure which prevents convection air currents. These baffles obstruct flow in substantially all of the enclosed volume. A significant improvement in thermal insulation at the stairway opening 17 is provided.

A support guide 94 is secured to the outer surface 96 of end wall 24. The support guide extends upward, above the wall 24 and has a contact surface 97 for guiding and directing the movement of the plate 28 upward and away from the frame during the opening of the cover 10. Further, the contact surface 97 of the guide 94 has a convex curvature so that the plate 28 is guided smoothly over the support guide as it bows outward as explained hereinafter.

A connecting cord 98 is secured at one end to the end 78 of the plate 28 and at the other end to the support guide 94, as illustrated, or to the frame, such as to end wall 24. The connecting cord 98 can be of any selected material such as rope or chain. The cord relates to a significant aspect of the invention. That is, as the plate 28 is moved from the closed to the the opened position, the cord 98 limits the distance that plate end 78 moves beyond the frame. Then, as the plate is continued to be slid open, it bows outward as illustrated in FIG. 1. Preferably, the plate projects in a longitudinal direction away from the frame a distance of less than about one half the length of the plate which projects outward from the frame when the plate is in the second position. This is significant because it reduces the length of the horizontal space required for operation of the cover. It is, however, within the terms of the invention to change the length of the connector cord and therefore the distance which the plate projects outward from the frame, as desired.

The thermal cover 10 of the invention is particularly advantageous in conjunction with the pull-down stairs 12. The space created between the closure plate 28 and the flat door 32 of the stairs forms a dead air pocket which is an effective means of insulating the attic from the room below the ceiling 14. The steps act as baffles to prevent air flow within the opening 26.

The invention has been described with reference to a preferred embodiment and it is apparent that many modifications may be incorporated into the design and configuration of the thermal cover discussed herein without departing from the spirit or the essence of the invention. It is my intention to include all such modifications and alterations insofar as they come within the scope of my invention.

Having thus described the invention, it is claimed:

1. A thermal cover, comprising:

a rectangular frame adapted to be positioned adjacent a support surface having a stairway opening, said frame having side walls and end walls forming an opening therethrough to provide substantially unobstructed access to said stairway opening;

a closure plate having a first position to close said opening through said frame for reducing heat transfer therethrough and a second position to open said opening through said frame for providing access therethrough; said closure plate being a sheet of material defined by side edges extending the length of said plate and end edges extending along the width at opposite ends of the plate, said sheet being flexible along its length and relatively rigid through its width;

mounting means on said side walls for sliding attachment of said closure plate to said frame so that said plate can be moved between said first and second positions.

2. A thermal cover as defined in claim 1 wherein said flexible sheet has a corrugated surface.

3. A thermal cover as defined in claim 2 wherein said corrugated surface includes a plurality of parallel grooves disposed perpendicularly to the side edges.

4. A thermal cover as defined in claim 1 wherein said closure plate is constructed of plastic.

5. A thermal cover as defined in claim 1 wherein said mounting means includes first and second grooves, one each along opposite facing surfaces of said side walls, each of said grooves receiving one of the side edges of said plate whereby said plate is slidingly attached to said frame for movement between said first and second positions.

6. A thermal cover as defined in claim 5 wherein said plate has a handle at one end for moving said plate between said first and second positions and stiffening the plate to keep it within said grooves.

7. A thermal cover as defined in claim 6 wherein said handle extends slightly less than the width between the first and second side walls.

8. A thermal cover as defined in claim 5 wherein each of said grooves includes;

a central section which extends parallel and adjacent to a longitudinal edge of the side walls for the majority of the length of the side walls;

a closed end section which is curved towards the lower side of the rectangular frame and is adapted to be disposed adjacent said support surface and terminates before the lower side surface to form a stop for one end of the plate; and an opened end section which is curved towards an upper sid of the rectangular frame extending through the upper side to enable the closure plate to move to the second position.

9. A cover as defined in claim 8 wherein the open section is spaced from an end wall a selected distance whereby said handle contacts the end wall and stops the closure plate from being completely withdrawn from the grooves.

10. A cover as defined in claim 1 further including a support guide for guiding said closure plate as the plate moves between the first and second positions.

11. A cover as defined in claim 10 wherein said support guide projects above said frame and includes a curved contact surface for guiding said closure plate as it moves upward and away from the frame into the second position.

12. A cover as defined in claim 11 wherein the curved contact surface of said guide element has a convex curvature so that said plate is guided smoothly upward and away from said frame.

13. A cover as defined in claim 12 wherein said guide element is securely affixed to the end wall of said frame.

14. A cover as defined in claim 11 further including a connector cord secured at a first end to an end of said plate and at the other end to said frame to force the plate to bow upward and outward as it moves away from the frame to it second position.

15. A cover as defined in claim 14 wherein the length of said connector cord is selected so that the plate moves in a longitudinal direction away from the frame a distance of less than about one half of the length of the plate projecting outward from the frame.

16. A cover as defined in claim 15 where said connector cord is connected at a second end to said guide element.

17. A cover as defined in claim 1 further including baffle means in said stairway opening for reducing air flow in said thermal cover.

18. A cover as defined in claim 17 wherein said baffle means comprises a set of pull-down stairs stored in said stairway opening.

19. A thermal cover for a stairway having an opening therethrough, comprising:

a pull-down stairway pivotably secured within the stairway opening when the stairs are in a closed position;

a rectangular frame disposed against the stairway opening, said frame having side walls and end walls forming an opening therethrough to provide substantially unobstructed access to said stairway opening;

a closure plate having a first position to close said opening through said frame for reducing heat transfer therethrough and a second position to open said opening through said frame for providing access therethorugh; said closure plate being a sheet of material defined by side edges extending the length of said plate and end edges extending along the width at opposite ends of the plate, said sheet being flexible along its length and relatively rigid through its width;

mounting means on said side walls for sliding attachment of said closure plate to said frame so that said plate can be moved between said first and second positions.

20. A thermal cover as defined in claim 19 wherein said flexible sheet has a corrugated surface.

21. A thermal cover as defined in claim 20 wherein said corrugated surface includes a plurality of parallel grooves disposed perpendicularly to the side edges.

22. A thermal cover as defined in claim 19 wherein said closure plate is constructed of plastic.

23. A thermal cover as defined in claim 19 wherein said mounting means includes first and second grooves, one each along opposite facing surfaces of said side walls, each of said grooves receiving one of the side edges of said plate whereby said plate is slidingly attached to said frame for movement between said first and second positions.

24. A thermal cover as defined in claim 23 wherein said plate has a handle at one end for moving said plate between said first and second positions and stiffening the plate to keep it within said grooves.

25. A thermal cover as defined in claim 24 wherein said handle extends slightly less than the width between the first and second side walls.

26. A thermal cover as defined in claim 23 wherein each of said grooves includes:

a central section which extends parallel and adjacent to a longitudinal edge of the side walls for the majority of the length of the side walls;

a closed end section which is curved towards the lower side of the rectangular frame and is adapted to be disposed adjacent said support surface and terminates before the lower side surface to form a stop for one end of the plate; and an opened end section which is curved towards an upper side of the rectangular frame extending through the upper side to enable the closure plate to move to the second position.

27. A cover as defined in claim 26 wherein the open section is spaced from an end wall a selected distance whereby said handle contacts the end wall and stops the closure plate from being completely withdrawn from the grooves.

28. A cover as defined in claim 19 further including a support guide for guiding said closure plate as the plate moves between the first and second positions.

29. A cover as defined in claim 28 wherein said support guide projects above said frame and includes a curved contact surface for guiding said closure plate as it moves upward and away from the frame into the second position.

30. A cover as defined in claim 29 wherein the curved contact surface of said guide element has a convex curvature so that said plate is guided smoothly upward and away from said frame.

31. A cover as defined in claim 30 wherein said guide element is securley affixed to the end wall of said frame.

32. A cover as defined in claim 29 further including a connector cord secured at a first end to an end of said plate and at the other end to said frame to force the plate to bow upward and outward as it moves away from the frame to its second position.

33. A cover as defined in claim 32 wherein the length of said connector cord is selected so that the plate moves in a longitudinal direction away from the frame a distance of less than about one half of the length of the plate projecting outward from the frame.

34. A cover as defined in claim 33 where said connector cord is connected at a second end to said guide element.

* * * * *